US007871509B2

(12) United States Patent
Matthews

(10) Patent No.: US 7,871,509 B2
(45) Date of Patent: Jan. 18, 2011

(54) PROCESS AND APPARATUS FOR MODIFYING BITUMEN

(76) Inventor: John Brodie Matthews, 33 Sutton Road, New Plymouth, Omata (NZ) 4310

( * ) Notice: Subject to any disclaimer, the term of this patent is extended or adjusted under 35 U.S.C. 154(b) by 249 days.

(21) Appl. No.: 11/658,141

(22) PCT Filed: Jul. 20, 2005

(86) PCT No.: PCT/NZ2005/000176

§ 371 (c)(1),
(2), (4) Date: Jan. 23, 2007

(87) PCT Pub. No.: WO2006/009474

PCT Pub. Date: Jan. 26, 2006

(65) Prior Publication Data

US 2008/0092777 A1 Apr. 24, 2008

(30) Foreign Application Priority Data

Jul. 23, 2004 (NZ) ..... 534302

(51) Int. Cl.
*C08L 95/00* (2006.01)

(52) U.S. Cl. ..... 208/6; 208/3; 208/4; 208/390; 422/224; 422/226; 422/228

(58) Field of Classification Search ..... 208/3–6, 208/40, 44, 390, 391; 366/336; 261/127–134, 261/151; 422/224, 226, 228
See application file for complete search history.

(56) References Cited

U.S. PATENT DOCUMENTS 2,179,208 A * 11/1939 Burk et al. ..... 208/4
3,108,060 A * 10/1963 Matthews, II ..... 208/44
3,531,375 A * 9/1970 Cheracci ..... 196/123
3,607,715 A 9/1971 Crawley
3,923,633 A 12/1975 Senolt et al.
3,985,622 A 10/1976 Hawkins
4,181,576 A 1/1980 Malick
4,185,025 A * 1/1980 Carduck et al. ..... 554/133
4,704,363 A 11/1987 Ziegler (Continued)

FOREIGN PATENT DOCUMENTS

DE 2436793 2/1976

(Continued)

OTHER PUBLICATIONS

Derwent Abstract Accession No. 94-046632/06, Sep. 7, 1993.

(Continued)

*Primary Examiner*—Robert J Hill, Jr.
*Assistant Examiner*—Brian McCaig
(74) *Attorney, Agent, or Firm*—Young & Thompson

(57) ABSTRACT

Apparatus for modifying bitumen. The apparatus includes a multi-section loop tube reactor A circulation pump (11) circulates bitumen in the reactor (10) and air is introduced at air injection point (13). Bitumen is introduced into the reactor (10) at inlet (14) by variable speed pump $P_1$. A plurality of mixers (15) are located between the air injection point (13) and a head section (24) beyond which is an outlet (27) where modified bitumen is drawn off by variable speed pump $P_2$.

19 Claims, 1 Drawing Sheet

U.S. PATENT DOCUMENTS

| | | | | |
|---|---|---|---|---|
| 4,778,586 | A * | 10/1988 | Bain et al. | 208/132 |
| 4,935,348 | A | 6/1990 | Oosterhuis et al. | |
| 5,073,496 | A | 12/1991 | Oosterhuis et al. | |
| 5,614,087 | A * | 3/1997 | Le | 210/180 |
| 2007/0280868 | A1 * | 12/2007 | Cisneros | 423/220 |

FOREIGN PATENT DOCUMENTS

| | | | |
|---|---|---|---|
| EP | 0111253 | | 6/1984 |
| EP | 0185407 | | 6/1986 |
| FI | 78495 | | 4/1998 |
| FR | 2197975 | | 3/1974 |
| GB | 1384401 | | 2/1975 |
| JP | 5015753 | | 1/1993 |
| JP | 2000144798 | | 5/2000 |
| NZ | 214155 | | 8/1988 |
| RU | 2157824 | | 10/2000 |
| RU | 2167183 | | 5/2001 |
| RU | 2203132 | | 4/2003 |
| RU | 2221834 | | 1/2004 |
| SU | 1198094 | A1 | 12/1985 |
| WO | 8703896 | | 7/1987 |
| WO | WO 94/06887 | * | 3/1994 |
| WO | WO 2004061053 | | 7/2004 |

OTHER PUBLICATIONS

Chemical Engineers' Handbook (Fifth Edition), Robert H. Perry/Cecil H. Chilton, 1973.

* cited by examiner

PROCESS AND APPARATUS FOR MODIFYING BITUMEN

BACKGROUND TO THE INVENTION

This invention relates to a process and apparatus for modifying bitumen.

Modifying bitumen and more particularly modifying the properties of bitumen by oxidising the bitumen is known. Oxidised or so-called "blown bitumen" is obtained by blowing or passing air through the bitumen when the bitumen is at a very high temperature e.g. 200-350° C. typically 240 to 280° C. The resultant modified bitumen is harder i.e. has an increased softening temperature and viscosity at comparable temperatures.

With use of appropriate reagents the properties of the bitumen can be modified further such that the bitumen viscosity is less temperature susceptible. These multi-grade bitumens are also known in the art.

The process of modifying bitumen by blowing is relatively slow. It can also be inherently dangerous due to the presence of volatile hydrocarbons in any airspace within the bitumen modifying apparatus. The process may also result in significant carbon deposits. The process is frequently inefficient. There may also be present the real risk of fire or explosion and consequential damage to plant and potentially injury to personnel.

The traditional bitumen modifying process can be a batch or continuous process. According to a simple form of apparatus to carry out the process, bitumen at an elevated temperature can be loaded into a container and air introduced into the lower part of the container so as to pass up through the bitumen. For example, a sparge ring can be provided in the base of the container for injecting the air into the bitumen.

According to another method the air can be introduced through the top of a container in which bitumen is located. The air and bitumen is mixed by a rotating stirring element or elements located within the bitumen. In this way air becomes dispersed through the bitumen.

SUMMARY OF THE INVENTION

An object of the present invention is to provide apparatus for modifying bitumen, which provides improved throughput efficiencies and in an inherently safe manner.

A further object of the present invention is to provide a process for more efficiently modifying bitumen in a very controllable manner to a wide range of specifications and in a safer manner.

Broadly according to one aspect of the present invention there is provided a process for modifying bitumen, the process including the steps of passing bitumen along a tubular path, causing the bitumen to pass through a plurality of mixers in the tubular path and injecting air into the bitumen at a point along the tubular path.

According to a second broad aspect of the invention there is provided apparatus for modifying bitumen, the apparatus including a tubular path along which bitumen can be moved, means for introducing air into the bitumen at a point along the tubular path and a plurality of mixers situated in the tubular path.

Preferably the apparatus includes an air compressor for supplying air to the means for introducing air.

Preferably the apparatus includes at least one port for the addition of catalysts and/or reagents.

To further increase the rate of production air may be heated prior to being injected into the tubular path.

Preferably the mixers are static mixers spaced apart along the tubular path.

To further increase the rate of production the apparatus may be operated at pressures above atmospheric pressures.

To further increase the rate of production a catalyst may be added. To modify bitumen in different ways e.g. produce multi-grade bitumen one or more reagents may be added.

BRIEF DESCRIPTION OF THE DRAWINGS

In the following more detailed description reference will be made to the accompanying drawings in which:—

DETAILED DESCRIPTION OF A PREFERRED EMBODIMENT OF THE INVENTION

Figure 1:
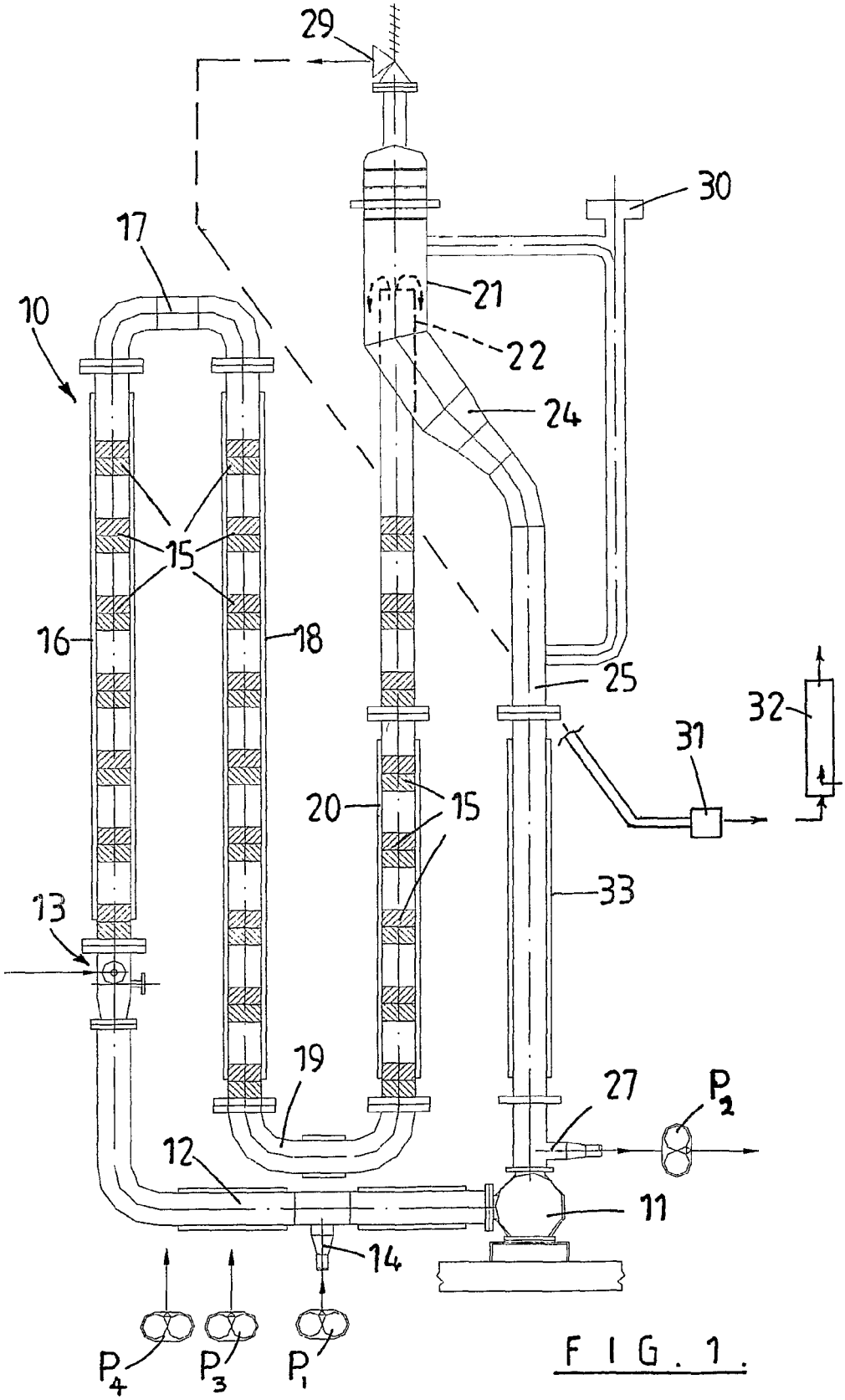
FIG. 1 is a somewhat schematic illustration of apparatus according to the invention and operable in accordance with the process of the invention.

The following description relates to one preferred form of apparatus for carrying out the invention. Essentially the apparatus comprises a tube reactor 10 and in the more preferred form of the invention an apparatus which effectively comprises a single but multi-section tube reactor. More particularly, the tube reactor is in the form of a loop reactor.

The apparatus 10 includes a circulation pump 11, which is coupled by tube 12 to an air injection point 13, which includes an air flow controller. At a point between the pump 11 and the air injection inlet 13 there is provided an inlet 14 for the intake of bitumen into tube 12. The control unit of the apparatus will control a variable pump speed $P_1$ to control the amount of bitumen being added into the reactor via inlet 14.

At initial start-up of the apparatus the reactor will be filled with bitumen prior to air injection commencing. Slowly the circulation pump 11 will be bought up to speed (when starting the apparatus) and then will be left at a substantially set speed. The air flow at air injection point 13 will also be slowly built up until a stable operating condition is established.

In operation the apparatus will always remain full of bitumen except, of course, for the air space in the head 21 and down at least inclined section 24 (hereinafter described) to the level of bitumen in column 25 (or into inclined section 24). Thus the apparatus is never emptied and consequently when the apparatus is not in operation it remains filled with bitumen.

The apparatus including pump 11 and variable speed pumps $P_1$ and $P_2$ the inlet 14 and outlet 27, and the tube reactor columns 16, 18, 20 and 33 respectively are jacketed. Thermal oil can be passed through the jackets for preheating the apparatus and contained bitumen as well as the bitumen pumps prior to commencement of the bitumen products manufacturing operation.

The circulation pump 11 operates to cause the bitumen to circulate at a desired rate in the apparatus 10. As a result the injected air becomes very finely dispersed into the bitumen by the static mixers 15.

One of the options to further increase the rate of production, according to one form of the invention, is to preheat the air injected at injection point 13.

In the preferred form of the invention the air is supplied from a compressor (not shown) which delivers air to the air injection point 13 at a pressure of about 6 to 7 bar (90-100 psi). The rate of addition of air into the apparatus can be typically at around 1.0 $m^3$/min at normal temperature and pressure (ntp).

The bitumen and air passes through tube section 16 which extends from air injection point 13. This section 16 incorporates therealong, at spaced intervals, the plurality of static mixers 15. Upon reaching the end of the tube 16, bitumen passes through the connecting piece 17 to second tube section 18 which also incorporates a plurality of spaced apart static mixers 15.

A further connecting section 19 takes the bitumen into a third tubular section 20 also incorporating a plurality of spaced apart static mixers 15.

Static mixers of varying configurations are known. In the present invention the static mixers 15 are of stainless steel construction.

The speed of pump 11 is adjusted to provide velocity of the fluid flow within the apparatus to match the functionality of the static mixers. The design of the static mixers create rapid changes in direction of the fluid flow and the resulting turbulent flow creates intimate intermixing of all components in the fluid flow.

Typically the bitumen will have an average dwell period in the apparatus of about two minutes.

Within a head section 21 bitumen issues from the end 22 of tube section 20. The bitumen under gravity flows down the inclined section 24 of head 21 and into a fifth tubular section 25 coupled via tubular section 33 to an outlet port 27 through which a portion of the blown bitumen circulating within the loop reactor issues. The portion of blown bitumen extracted by variable speed pump $P_2$ from the reactor at outlet port 27 is controlled by a control unit deriving information from a level sensor 30. As a result of the variable control of pump $P_2$ the level (height) of bitumen in column 25 or up inclined section 24 will remain constant. The controller 30 can be of any suitable type such as a radar unit.

A vapour outlet 29 is coupled to the head section 21. Through this outlet 29 exits vapour comprising low oxygen content air and volatiles. While not shown, an explosion vent will generally be connected to the air and vapour output section 29. Air and volatiles will pass through a pressure control valve 31 to be burnt off (incinerated) in incinerator 32. This pressure control valve 31 also regulates the pressure within the apparatus to around 6-7 bar (90-100 psi) the effect of which is to increase the rate of reaction for the modification of the bitumen.

In a preferred form of the invention the vapours of air and volatiles will pass to a heat exchanger type incinerator 32 so that the burnt off air/vapour mixture can be used for heating say thermal oil passing through a coil of the heat exchanger. The thus heated thermal oil can then be used for other processing activities such as preheating of the bitumen and/or air. Alternatively the air and volatiles may be fed into a simple incinerator for burning off.

According to one form of the invention the bitumen can be supplied to the tube reactor 10 at a temperature of about 220-230° C. which results in the processed bitumen exiting the reactor at a temperature of about 230-240° C. To increase the speed of the reaction the air pressure in the head will as described above, be somewhere in the order of 6-7 bar (about 90-100 psi).

Bitumen by being injected with air from a compressor and then passed through a number of sections having a plurality of spaced apart static mixers, because of the intimate contact of the oxygen in the air with the bitumen, provides considerable advantages over blown bitumen achieved by using conventional oxidising plants. The throughput of the apparatus of the present invention will be in the order to 10-20 tonnes per hour which compares favourably with throughputs of 5-10 tonnes per hour in conventional comparative plants.

It will be appreciated by those skilled in the art that the apparatus and process is open to modification within the scope of the invention. For example, rates of bitumen modification can be further increased by adding further sections of tube and static mixers, increasing tube and static mixer sizes and/or increasing the rate of air injection into the apparatus.

In a further embodiment the static mixers could be replaced entirely or partially by rotating mixers or mixers having driven mixing elements.

According to one preferred form of the invention the loop reactor is located in a vertical orientation. However, in an alternative arrangement the tubular elements could be horizontally disposed (at least in part) but with at least part of section 20 vertical (or some other orientation) leading to vertically disposed head section 21 and the inclined section 24 leading to vertically orientated section 25.

The enhanced efficiency of the apparatus compared to conventional bitumen blowing plants is due to an increased rate of reaction brought about by the highly efficient dispersal of oxygen within the bitumen achieved by the rapid movement of the bitumen and air through the plurality of static mixing elements.

The process and apparatus according to the present invention provides a very stable and controllable means of modifying bitumen. It also enables the production of a wide range of bitumen specifications including multi-grade bitumens.

The process can be carried out in the presence of catalysts and reagents if such are required in order to achieve the desired end specification of the bitumen. The reagent can be added by way of pump $P_3$ and the catalysts by way of pump $P_4$.

This better distribution of oxygen through the bitumen is illustrated by the air entering via the inlet 13 having a composition of 20.5% oxygen whereas the vapour exiting the apparatus has an oxygen content of about 7.5%. It is known that with conventional oxidising plants the vapours exiting the plant can have oxygen contents as high as 19.5%. Thus, relatively low volumes of air both enters and leaves the apparatus.

This better reaction of the oxygen with the bitumen inherently provides for a faster and more efficient modification of the bitumen and for a safer process. The volatiles exiting the apparatus are such that the possibility of explosion is significantly reduced. Also, the vapours can be burnt off in a controlled and safe manner.

Also as a consequence of this, the apparatus is cleaner in operation and thus the significant carbon deposits associated with conventional plants do not arise. Also the turbulent flow through the mixers leads to self-cleaning. Therefore a need for cleaning or regular cleaning is removed.

Furthermore the design of the apparatus is such that there is significantly less air space above the surface of the bitumen is present and which contains significantly reduced oxygen content in the air. This significantly reduces the impact of any explosions that occur in such air space in the event of ignition of the volatile hydrocarbon vapours in such air space.

Consequently, not only does the process and apparatus of the present invention provide for improved throughput of oxidised bitumen, it does so in a manner which has less air space and produces a lower level of volatiles and carbon deposits which inherently results in cleaner and safer operation.

The invention claimed is:

1. A process for modifying bitumen, comprising the steps of:

passing bitumen along a tubular path;

injecting air into the bitumen at an air introduction point located along the tubular path; and causing the bitumen and the injected air to pass through a plurality of static mixers spaced along a section of the tubular path.

2. A process as claimed in claim 1, wherein the air is heated prior to being injected into the tubular path.

3. A process as claimed in claim 1, wherein the process is carried out at a pressure above atmospheric pressure.

4. A process as claimed in claim 1, further including the addition of one or more catalysts and/or reagents to the bitumen circulating in the tubular path.

5. A process as claimed in claim 1, wherein the process is continuous with the addition of bitumen into the tubular path and extraction of modified bitumen from the tubular path.

6. A process as claimed in claim 1, wherein the bitumen is introduced to the tubular path at a temperature in excess of 220° C.

7. A process as claimed in claim 1, further comprising the step of removing vapor from the tubular path through a vapor outlet.

8. A process as claimed in claim 1, wherein the tubular path is provided by a loop reactor, the process using a circulation pump to cause the bitumen to circulate in the tubular path.

9. An apparatus for modifying bitumen, the apparatus comprising:

a continuous loop tubular path along which bitumen can be moved;

an inlet pump having a controllable variable speed for introduction of bitumen into the continuous tubular path at a desired rate;

a circulation pump for causing the bitumen to circulate around the continuous tubular path;

one or more pumps for the introduction of one or more of air, reagents, and catalysts into the tubular path;

a plurality of static mixers spaced along a section of the tubular path located after a point or points where the one or more of air, reagents, and catalysts are introduced;

a head section into which the bitumen flows after passing through the static mixers, the head section having an outlet connected to a further section of the tubular path which leads to an outlet port for extraction of the modified bitumen from the tubular path;

an extraction pump configured to pump modified bitumen through the outlet port for extraction of a portion of the modified bitumen from the tubular path;

a level sensor configured to sense a level of bitumen in the head section or the further section of the tubular path; and one or more controllers configured to control the inlet pump to control the rate of introduction of bitumen into the continuous tubular path and to control the extraction pump in accordance with information received from the level sensor.

10. An apparatus for modifying bitumen, the apparatus comprising:

a continuous loop tubular path along which bitumen can be moved;

an inlet pump having a controllable variable speed for introduction of bitumen into the continuous tubular path at a desired rate;

a circulation pump for causing the bitumen to circulate around the continuous tubular path;

an air injection inlet for introduction of air into the bitumen at a point along the tubular path;

a plurality of static mixers spaced along a section of the tubular path located after the air introduction point;

a head section into which bitumen flows after passing through the static mixers, the head section having an outlet connected to a further section of the tubular path which leads to an outlet port for extraction of the modified bitumen from the tubular path;

a vapor outlet coupled to the head section for removal of vapor from the apparatus;

an extraction pump configured to pump modified bitumen through the outlet port for extraction of a portion of the modified bitumen from the tubular path;

a level sensor configured to sense a level of bitumen in the head section or the further section of the tubular path; and one or more controllers configured to control the inlet pump to control the rate of introduction of bitumen into the continuous tubular path and to control the extraction pump in accordance with information received from the level sensor.

11. An apparatus as claimed in claim 10, further comprising an air compressor for supplying air to the air injection inlet.

12. An apparatus as claimed in claim 10, wherein the compressor delivers air to the air injection inlet at a pressure of about 6 to 7 bar.

13. An apparatus as claimed in claim 12, configured to introduce the air into the tubular path at about 1.0 $m^3$/min at normal temperature and pressure.

14. An apparatus as claimed in claim 10, further comprising a heating element for heating air prior to the air being introduced into the tubular path.

15. An apparatus as claimed in claim 10, further comprising at least one port for the addition of at least one of a catalyst and/or reagent.

16. An apparatus as claimed in claim 10, wherein the tubular path is formed by a multi-section loop reactor.

17. An apparatus as claimed in claim 10, further comprising an explosion vent connected to the vapor outlet.

18. An apparatus as claimed in claim 10, further comprising a pressure control valve coupled to the head section to regulate pressure within the apparatus.

19. An apparatus as claimed in claim 18, wherein the pressure control valve is operative to regulate the pressure to about 6-7 bar.

* * * * *